United States Patent [19]

Simmons et al.

[11] 4,058,270

[45] Nov. 15, 1977

[54] STRAP DISPENSING SYSTEM

[75] Inventors: James R. Simmons, Frankfort; Robert P. Rogowski, Ottawa, both of Ill.

[73] Assignee: Interlake, Inc., Oak Brook, Ill.

[21] Appl. No.: 713,926

[22] Filed: Aug. 12, 1976

[51] Int. Cl.[2] ..... B65H 17/52; B21C 47/16

[52] U.S. Cl. ..... 242/105; 242/78.6

[58] Field of Search ..... 242/105, 54 R, 78.6, 242/78.7, 58.6, 128, 129

[56] References Cited

U.S. PATENT DOCUMENTS

| | | | |
|---|---|---|---|
| 3,162,394 | 12/1964 | Culpepper | 242/78.6 |
| 3,544,029 | 12/1970 | Meier | 242/78.6 |
| 3,575,358 | 4/1971 | Manner | 242/105 |
| 3,810,591 | 5/1974 | Haven | 242/78.6 |

*Primary Examiner*—Edward J. McCarthy
*Attorney, Agent, or Firm*—Vogel, Dithmar, Stotland, Stratman & Levy

[57] ABSTRACT

A system for dispensing steel strapping material from a heavy coil thereof includes a pallet having laterally spaced-apart elongated feet and adapted for supporting the coil on its side with its axis disposed vertically to form a strapping material assembly, the pallet having a positioning hub for preventing horizontal movement of the coil thereon. A horizontal turntable is rotatably driven about a vertical axis by an air motor and it includes a pair of laterally spaced-apart elongated roller conveyor tracks for respectively receiving the pallet feet for rolling the pallet to a dispensing position on the turntable coaxial therewith. The track assemblies engage the sides of the pallet feet and cooperate with positioning bars spanning the ends of the track assemblies for limiting horizontal movement of the pallet, while a hold-down assembly cooperates with the turntable to prevent vertical movement of the pallet. Control means controls the actuation of the air motor in accordance with the demand of associated strap-utilizing equipment. An entry conveyor comprising track assemblies like those on the turntable may be utilized for storing a spare pallet and coil and facilitating rolling thereof onto the turntable.

20 Claims, 13 Drawing Figures

SOURCE
MANUAL
FIL.
REG.
LUB.
START-STOP
MUFF.
BRAKE
FLOW CONT.
EXH.

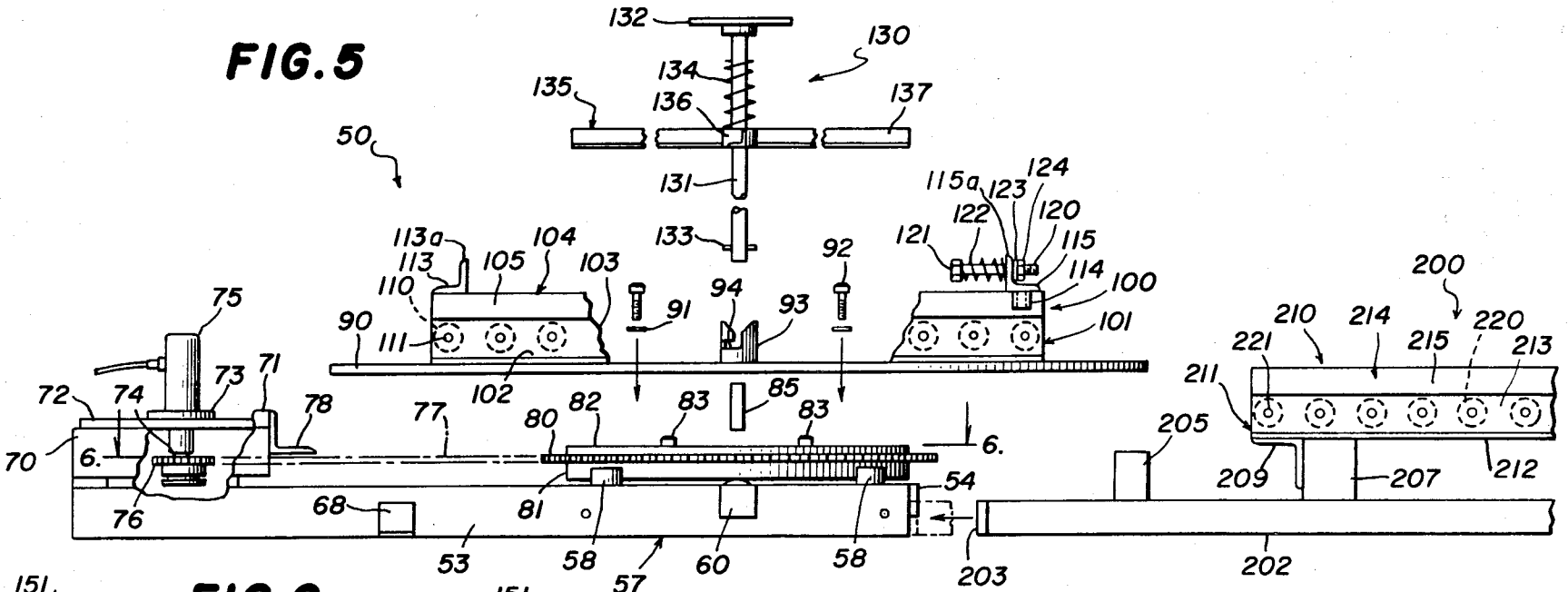
FIG. 5
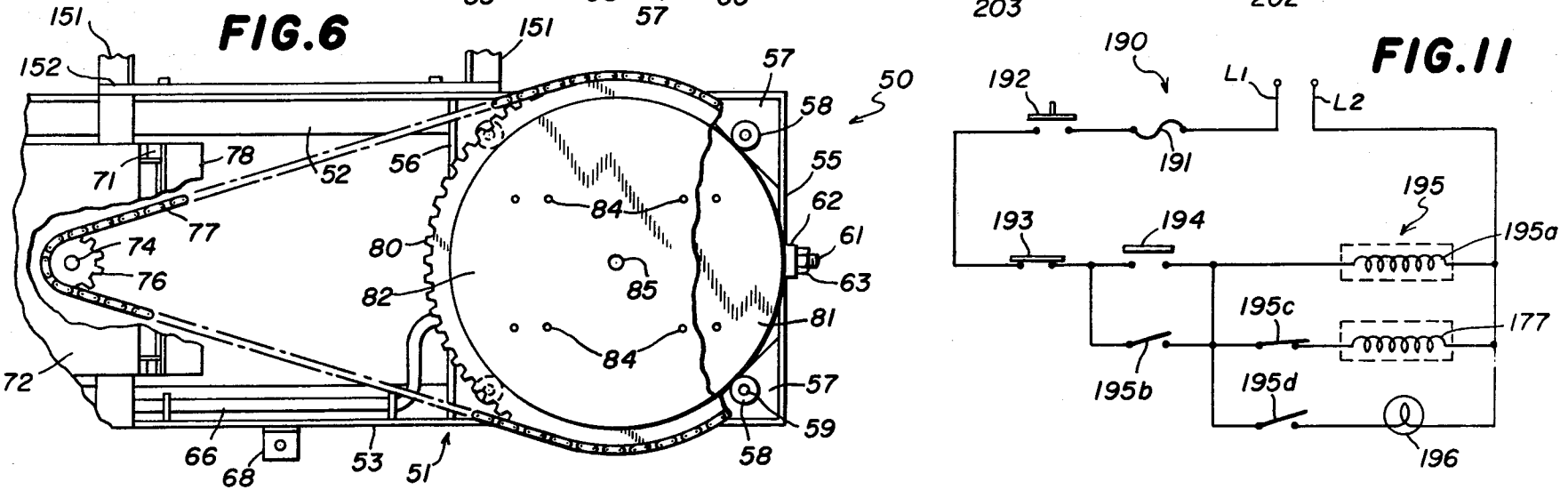
FIG. 6
FIG. 11

STRAP DISPENSING SYSTEM

BACKGROUND OF THE INVENTION

The present invention relates to systems and apparatus for dispensing a continuous strip of strapping material from a coil thereof for use by associated strap-utilizing equipment. More particularly, the invention relates to a system for dispensing steel strapping material wound in very large, heavy coils.

Steel strapping material is shipped from the manufacturer in tightly wound coils. The strapping material is typically used with a strapping machine for wrapping the strapping around objects to be strapped. For this purpose, the coil is rotatably mounted on a suitable dispenser or coil unreeler for facilitating withdrawing of the strapping material from the coil. Such coil unreelers are disclosed, for example, in U.S. Pat. No. 3,717,313, issued Feb. 20, 1973 to W. Q. Williams, U.S. Pat. No. 3,688,999, issued Sept. 5, 1972 to R. F. Plattner et al., and U.S. Pat. No. 3,162,394, issued Dec. 22, 1964 to J. W. Culpepper et al. In each of these prior art unreelers, the coil is mounted on a hub structure for rotation by suitable drive means or by withdrawing force exerted on the withdrawn portion of the strapping material by the strapping machine or other strap-utilizing apparatus.

These dispensers and coil unreelers are quite suitable for use with coils weighing up to a few hundred pounds. But in recent years steel strapping material is being provided by the manufacturers wound in much larger coils, weighing up to one thousand pounds and more, and it may be expected that still larger coils will be forthcoming in the future. The handling of these extremely heavy coils is quite difficult and in some cases virtually impossible, since it has been found that even forklift trucks have great difficulty in handling one-thousand-pound coils. Thus, the prior art coil dispensers and unreelers are unsuitable for use with today's heavier coils because all of these prior dispensers require considerable handling of the coil in order to place it on the unreeler, particularly with vertical-type unreelers of the aforementioned U.S. Pat. Nos. 3,717,313 and 3,688,999.

SUMMARY OF THE INVENTION

The present invention provides an improved apparatus and system for dispensing steel strapping material from very heavy coils thereof.

More particularly, it is a primary feature of the present invention that there is provided an apparatus and system for dispensing steel strapping material from a very heavy coil thereof, which apparatus and system eliminates handling of the coil.

Another feature of this invention is the provision of a dispensing system which includes a strapping material assembly comprising a special pallet upon which the coil is supported and fixedly positioned, which pallet may readily be handled by existing pallet-handling equipment for shipping, storage and the like, and a horizontal turntable for receiving the entire pallet thereon for rotation therewith, so that the coil itself does not have to be handled.

It is another feature of this invention that the pallet is securely held in a dispensing position on the turntable during rotation thereof.

Yet another feature of the invention is the provision of means on the turntable to facilitate the movement of the pallet therealong to the dispensing position.

Still another feature of the invention is that the turntable is positively driven in response to a demand for strapping material by the associated strap-utilizing equipment.

Yet another feature of this invention is the provision of means for storing a pallet adjacent to the turntable and facilitating movement of the pallet onto the turntable.

These features are accomplished in the present invention and it is an object of the present invention to accomplish these desired results by providing apparatus for dispensing a continuous strip of strapping material from a heavy coil thereof supported on a pallet and held against horizontal movement with respect thereto with the axis of the coil disposed substantially vertically, the apparatus comprising a substantially horizontal turntable mounted for rotation about a substantially vertical axis and adapted for receiving the pallet thereon in a dispensing position with the coil disposed substantially coaxially with the turntable, pallet positioning means on the turntable for holding the pallet in the dispensing position thereof, and drive means for effecting rotation of the turntable in a coil-unreeling direction, whereby strap may be dispensed directly from the pallet by rotation of the turntable without handling of the coil or removal thereof from the pallet.

In connection with the foregoing object, it is another object of this invention to provide apparatus of the type set forth which includes first and second pallet positioning means for respectively preventing horizontal and vertical movement of the pallet from the dispensing position thereof.

It is another object of this invention to provide apparatus of the type set forth, wherein the pallet has a pair of elongated substantially parallel laterally spaced-apart feed depending therefrom, the turntable having a pair of elongated laterally spaced-apart track assemblies thereon adapted for respectively receiving the feet therein for engagement therewith to prevent lateral horizontal movements of the pallet.

Still another object of this invention is to provide apparatus of the type set forth which includes control means coupled to the drive means for controlling the actuation thereof in response to the amount of dispensed strapping material accumulated between the coil and the associated strap-utilizing equipment.

It is yet another object of this invention to provide apparatus of the type set forth, which further includes entry conveyor means disposed adjacent to the turntable for receiving a pallet thereon and facilitating horizontal movement of the pallet onto the turntable track means.

In connection with the foregoing object, it is another object of this invention to provide apparatus of the type set forth which includes coupling means for interconnecting the turntable and the entry conveyor means in a loading configuration with the track means and the entry conveyor disposed in longitudinal alignment for facilitating horizontal movement of the pallet from the entry conveyor means onto the track means.

Yet another object of this invention is to provide a strapping material assembly comprising a pallet having positioning means thereon and an elongated continuous strip of strapping material arranged in a coil on the pallet with the axis of the coil disposed substantially vertically and with the coil disposed in engagement with the positioning means to prevent horizontal movement of the coil with respect to the pallet.

In connection with the foregoing objects, it is still another object of this invention to provide a system for dispensing a continuous strip of strapping material from a heavy coil thereof, which includes a strapping material assembly of the type set forth and dispensing apparatus of the type set forth.

Further features of the invention pertain to the particular arrangement of the parts of the strap dispensing system whereby the above-outlined and additional operating features thereof are attained.

The invention, both as to its organization and method of operation, together with further objects and advantages thereof, will best be understood by reference to the following specification taken in connection with the accompanying drawings.

BRIEF DESCRIPTION OF THE DRAWINGS

FIG. 5 is a fragmentary side elevational view of the dispensing system of FIG. 4, with the entry conveyor shown uncoupled from the turntable and with the turntable shown in exploded view;

FIG. 6 is a fragmentary view in horizontal section taken along the line 6—6 in FIG. 5 and showing the turntable drive mechanism;

FIG. 11 is a schematic diagram of the electrical control circuit of the present invention;

DESCRIPTION OF THE PREFERRED EMBODIMENTS

Figure 13:
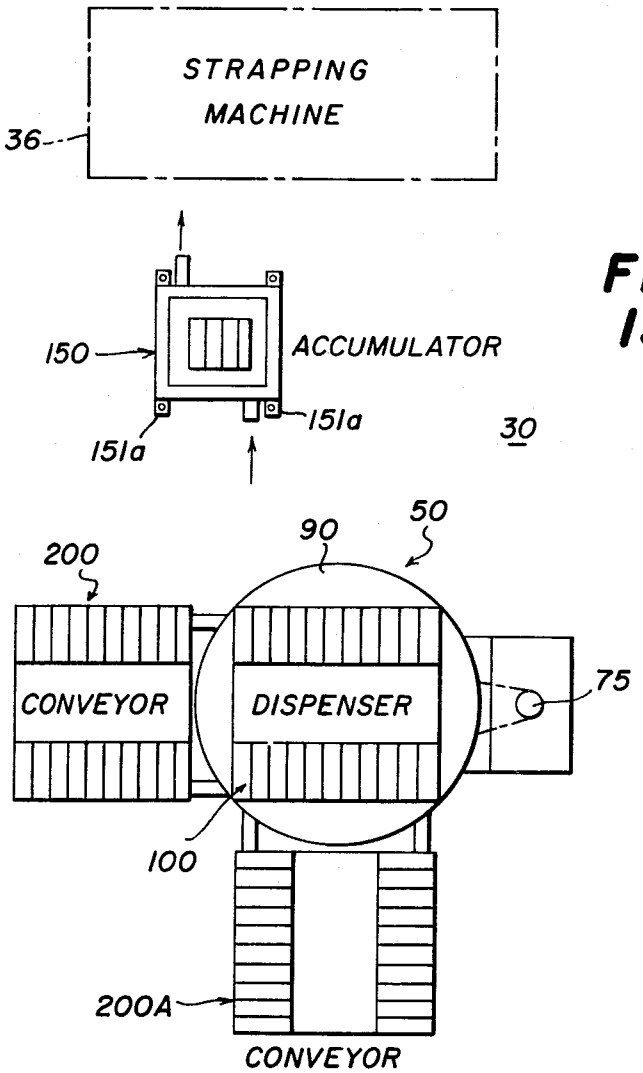
FIG. 13 is a view similar to FIG. 10, illustrating an alternative arrangement wherein the air motor is disposed on the side of the turntable away from the accumulator tower.
Figure 12:
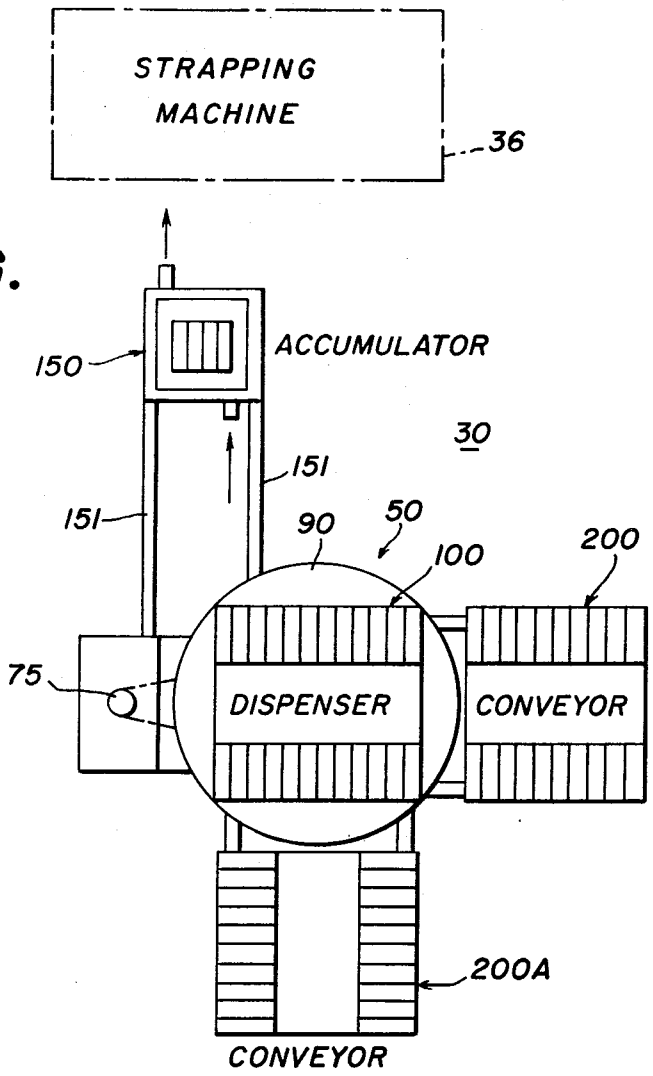
FIG. 12 is a diagrammatic top plan view of the dispensing system of the present invention, with the entry conveyor arranged at the rear of the turntable or at the side thereof away from the accumulator tower.

Referring now to FIGS. 1 through 4 of the drawings, there is illustrated a strap dispensing system, generally designated by the numeral 30, for dispensing a continuous strip of steel strapping material from a coil 31 thereof, to associated strap-utilizing equipment such as a strapping machine 36 or the like (see FIGS. 12 and 13). Typically, the steel strapping material is wound in twelve-inch-face coils weighing approximately one thousand pounds each. The strap dispensing system 30 includes a special pallet, generally designated by the numeral 40, for supporting the coil 31 thereon, a turntable assembly, generally designated by the numeral 50 for unreeling the coil 31, and an accumulator tower, generally designated by the numeral 150, for feeding the withdrawn portion 35 of the steel strapping material from the coil 31 to the strapping machine 36, and controlling the operation of the turntable assembly 50.

The pallet 40 is preferably formed of wood and includes a pair of laterally spaced-apart, elongated, parallel feet 41 and 42, interconnected at the upper surface thereof by a plurality of longitudinally spaced-apart, parallel cross planks 43, the upper surfaces of which are substantially coplanar and define a platform for supporting the coil 31 thereon. Secured to the upper surfaces of central ones of the cross planks 43, and disposed centrally of the pallet 40, are two laterally spaced-apart hub bars 44 and 45, dimensioned and arranged so that the outer sides and ends thereof lie along a common circumscribing square. The outer corners of the hub bars 44 and 45 disposed adjacent to the corners of the circumscribing square are mitered as at 46, so that the diagonal distance from one of the mitered corners 46 to the opposite one is substantially equal to the inner diameter of the coil 31.

The coil 31 is placed on the cross planks 43 with the axis of rotation of the coil 31 disposed substantially vertically and with the hub bars 44 and 45 received within the coil 31 so that the mitered corners 46 snugly engage the inner cylindrical surface 33 of the coil 31, thereby to position the coil 31 centrally of the pallet 40 and prevent horizontal movement of the coil 31 with respect to the pallet 40. Preferably, the coil 31 is placed on the pallet 40 at the coil manufacturer's plant and is shipped on the pallet 40 to the location at which the strapping material is to be used. During such shipment, it will be appreciated that the coil 31 itself need not be handled, the entire pallet 40 with the coil 31 thereon forming a strapping material assembly which is moved by the use of forklift trucks in standard fashion.

Figure 7:
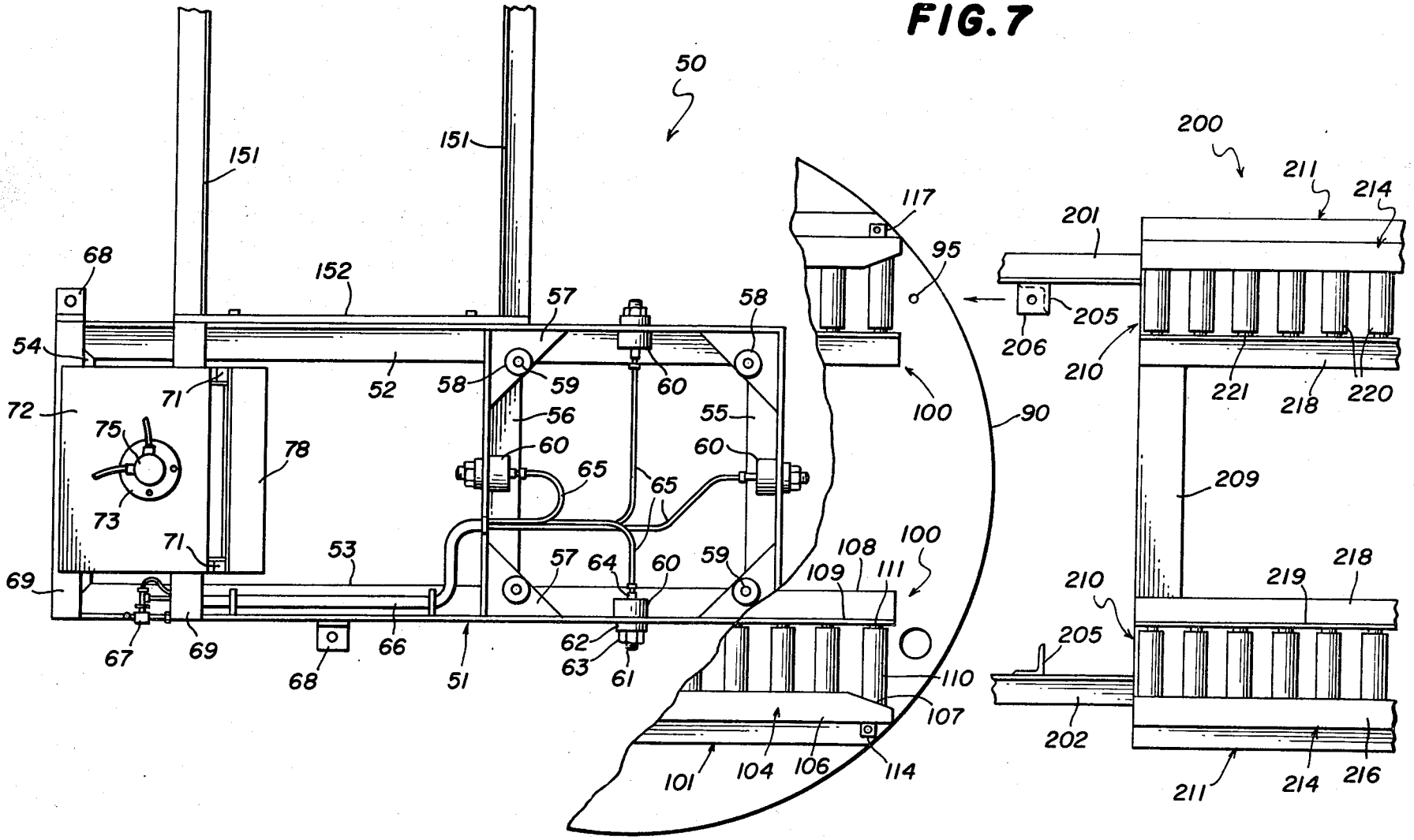
FIG. 7 is an enlarged fragmentary view similar to FIG. 4, with portions of the turntable broken away to show the lubricating mechanism therefor.

The turntable assembly 50 is located at the place where the strapping material is to be used, and is mounted on a frame, generally designated by the numeral 51. Referring also to FIGS. 5 through 7 of the drawings, the frame 51 includes a pair of laterally spaced-apart elongated side rails 52 and 53 interconnected at the opposite ends thereof by end rails 54 and 55, and interconnected intermediate the ends thereof by a cross rail 56, thereby to form a rigid rectangular framework. At the corners defined by the intersections of the side rails 52 and 53 with the end rail 55 and cross rail 56, there are secured to the upper surfaces thereof four triangular gusset plates 57, each supporting a guide roller 58 mounted for rotation with respect to a vertically disposed shaft 59. Respectively fixedly secured to the end rail 55 and the cross rail 56 midway between the ends thereof, and to side rails 52 and 53 midway between the end rail 55 and cross rail 56, are four support rollers 60. Each of the support rollers 60 is mounted for rotation about a substantially horizontal shaft 61 held in place by a washer 62 and a nut 63, and being provided with a grease fitting 64 coupled to a lubrication line 65. The four lubrication lines 65 are bundled together in a plastic tubing 66 and channeled through the cross rail 56 and along the side rail 53 to a grease fitting 67 fixedly secured to the side rail 53 adjacent to the end rail 54. The support rollers 60 all extend slightly above the upper edges of the end rails 55 and 56 and side rails 52 and 53 and are all tangent to a common imaginary horizontal support plane. Preferably, the frame 51 is anchored to the underlying floor or support surface by means of bolts or the like passed through suitable anchor brackets 68.

Interconnecting the side rails 52 and 53 along the upper edges thereof adjacent to the end rail 54 are two spaced-apart support rails 69. Supported by the support rails 69 are two upstanding laterally spaced-apart support plates 70 disposed substantially parallel to the side rails 52 and 53, and each provided at the inner end thereof with an upstanding projection 71. Spanning the support plates 70 rearwardly of the projections 71 is a rectangular mounting plate 72 having an aperture therein for receiving therethrough the shaft 74 of an air motor 75, which is provided with a mounting flange 73 which overlies the mounting plate 72 and is fixedly secured thereto by suitable fastening means. Fixedly secured to the lower end of the motor shaft 74 beneath the mounting plate 72 is a sprocket 76 which engages one end of a continuous-loop drive chain 77. Fixedly secured to the front ends of the support plates 70 and extending therebetween is a chain guard 78 in the form of an angle iron.

The drive chain 77 is disposed in a substantially horizontal plane beneath the chain guard 78 and above the upper edges of the side rails 52 and 53. The other end of the drive chain 77 is disposed in engagement with a large sprocket 80 which is sandwiched between a circular guide plate 81 and a circular spacer plate 82, the plates 81 and 82 and sprocket 80 all being fixedly secured together by threaded fasteners 83 in apertures 84. The guide plate 81 is dimensioned to rest upon the support rollers 60 with the peripheral cylindrical surface of the guide plate 81 disposed in rolling engagement with the guide rollers 58, so that the guide plate 81 is freely rotatable and is centered in position by the guide rollers 58. A lockpin 85 is also received in complementary apertures in the center of the plates 81 and 82 and sprocket 80.

Overlying the spacer plate 82 coaxially therewith is a circular turntable 90 having a radius only slightly less than the distance between the chain guard 78 and the center of the spacer plate 82. The turntable 90 is fixedly secured to the spacer plate 82, sprocket 80 and guide plate 81 by means of a plurality of bolts or screws 92 which cooperate with lock washers 91. Disposed centrally of the turntable 90 and projecting upwardly therefrom coaxially therewith is a hollow rectangular hub 93, having right-angle slots 94 formed in opposite side walls thereof. Formed in the turntable 90 adjacent to the periphery thereof is a pin aperture 95, for a purpose to be described more fully below.

Figure 8:
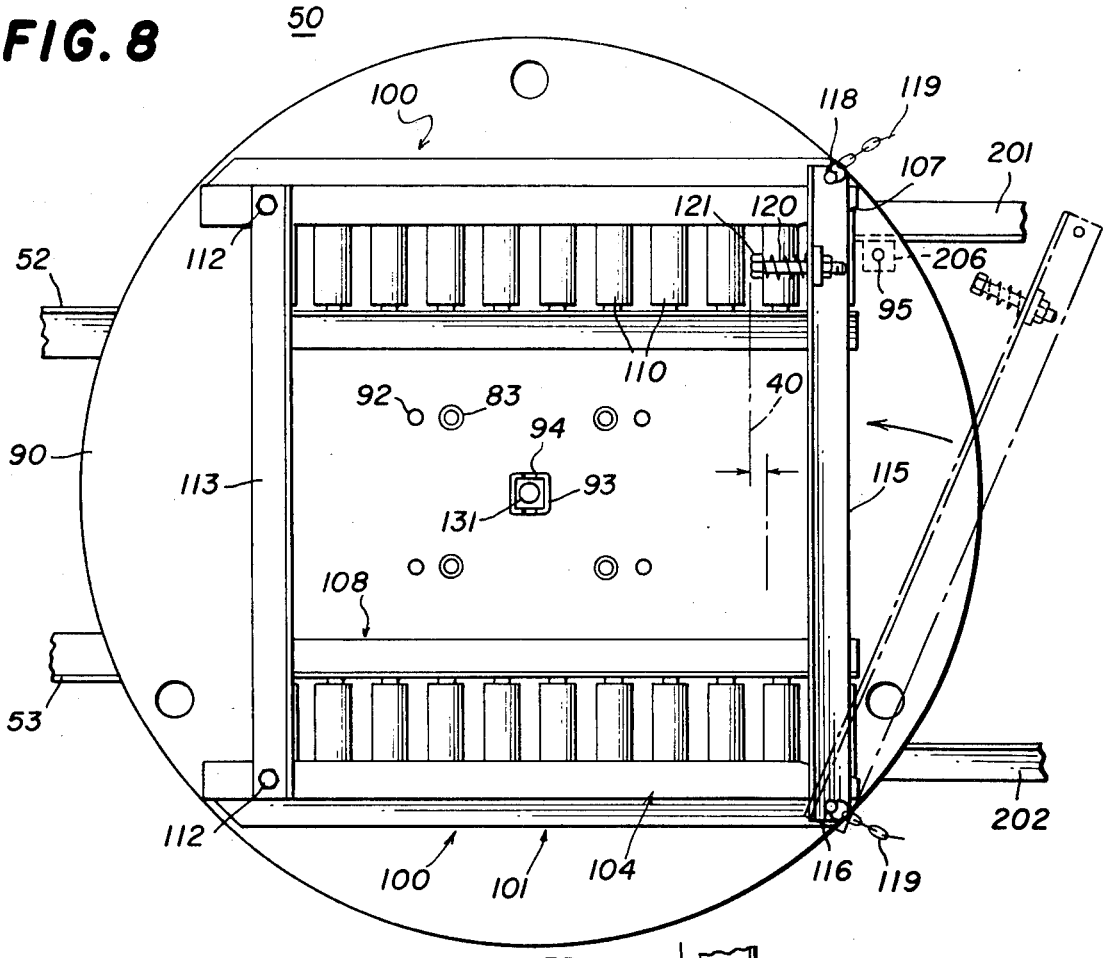
FIG. 8 is an enlarged fragmentary top plan view of the turntable of the dispensing system of FIG. 4, illustrating the movement of the movable retaining bar.

Referring now also to FIG. 8 of the drawings, a pair of elongated, laterally spaced-apart track assemblies, each generally designated by the numeral 100, is mounted on the turntable 90, the track assemblies 100 being arranged substantially parallel to each other and equidistantly spaced from the center of the turntable 90. Each track assembly 100 includes a bottom outer rail 101 in the form of an angle iron having an attachment flange 102 fixedly secured to the upper surface of the turntable 90, and an upstanding inner bearing flange 103, the rail 101 being arranged substantially as a chord of the circular turntable 90. An outer top rail 104, also in the form of an angle iron, has a vertically disposed attachment flange 105 arranged in parallel overlapping relationship with the bearing flange 103 of the outer bottom rail 101 and fixedly secured thereto as by welding, and also having a horizontally disposed and inwardly extending retaining flange 106, provided at one end thereof with a tapered entry portion 107. Spaced radially inwardly from the outer bottom rail 101 and disposed parallel thereto is an elongated inner rail 108 which is fixedly secured to the turntable 90 and is provided with an upstanding bearing flange 109.

Disposed between the outer bottom rail 101 and the inner rail 108 is a plurality of laterally extending and longitudinally spaced-apart cylindrical rollers 110, each being mounted for rotation about a substantially horizontal shaft 111, the opposite ends of which are respectively received in complementary openings in the bearing flanges 103 and 109 of the rails 101 and 108. The rollers 110 are so arranged that the upper surfaces thereof are all disposed tangent to a common support plane which is substantially parallel to the upper surface of the turntable 90 and is disposed a predetermined distance below the upper edges of the bearing flange 103 and the retaining flange 106. The width of each of the track assemblies 100, and the spacing therebetween is such that the elongated feet 41 and 42 of a pallet 40 may be respectively received in rolling engagement with the rollers 110 of the two track assemblies 100 for free rolling transport therealong.

Extending between the retaining flanges 106 of the track assemblies 100 adjacent to the rear ends thereof is a fixed positioning bar 113 in the form of an angle iron, one flange of which is disposed horizontally and has the opposite ends thereof respectively fixedly secured to the retaining flanges 106 by suitable fastening members 112, with the upstanding flange of the angle iron being disposed inwardly of the track assemblies 100. Respectively fixedly secured to the attachment flanges 105 of the outer top rails 104 adjacent to the entry ends thereof are pivot blocks 114 and 117 which are respectively provided with vertically disposed apertures therethrough for respectively receiving therein release pivot pins 116 and 118, which are preferably tied to the outer bottom rails 101 by sash chains 119 to prevent loss or misplacement. A movable positioning bar 115 in the form of an angle iron is adapted to be disposed across the entry ends of the track assemblies 110, with the upstanding flange **115*a* disposed inwardly of the track assemblies 100 in facing parallel relationship with the upstanding flange 113*a* of the fixed positioning bar 113. The movable positioning bar 115 is provided at the opposite ends thereof with complementary apertures respectively disposed for alignment with the apertures in the pivot blocks 114 and 117 for receiving the pins 116 and 118 therethrough, thereby to releasably secure the movable positioning bar 115 to the track assemblies 100. It will be appreciated that when either one of the release pivot pins 116 or 118 is removed, the movable positioning bar 115 may be pivoted about the other release pivot pin, as indicated in broken line in FIG. 8, from a holding condition across the entry ends of the track assemblies 100 to a retracted condition out of the way of the entry ends of the track assemblies 100 to facilitate the movement of a pallet 40 onto the track assemblies 100**.

Extending through a complementary opening in the upstanding flange **115*a*** of the movable positioning bar 115 adjacent to one end thereof is a substantially horizontally disposed positioning plunger 120 provided with a head 121 at the inner end thereof and surrounded by a helical compression spring 122 which is trapped between the head 121 and the flange 115*a*, the plunger 120 being secured in place by a washer 123 and adjustment nut 124 threadedly engaged with the plunger 120 along the outer side of the flange 115*a*. The coil compression spring 120 urges the head 121 of the plunger 120 inwardly to a point determined by the adjustment of the nut 124.

In operation, the movable positioning bar 115 is pivoted outwardly about one of the release pivot pins 116 or 118 until it is substantially parallel to the track assemblies 100, for loading of a coil 31 onto the turntable 90. It is a significant feature of the present invention that the entire pallet 40, with the coil 31 positioned thereon is loaded onto the turntable 90, with the feet 41 and 42 of the pallet 40 being respectively received onto the rollers 110 of the track assemblies 100 in rolling engagement therewith, with the tapered entry ends 107 of the retaining flanges 106 serving to help guide the pallet feet 41 and 42 onto the rollers 110. The movement of the pallet 40 onto the track assemblies 100 may be accomplished by a forklift truck, or the like in a well-known manner. It is not necessary to either remove the coil 31 from the pallet 40, or to move the coil 31 from its horizontal resting position with the axis of rotation thereof disposed vertically.

The pallet 40 is rolled along the track assemblies 100 until it abuts the upstanding flange 113*a* of the fixed positioning bar 113. Then the movable positioning bar 115 is pivoted back into the solid line holding position illustrated in FIG. 8 and the release pivot pin 118 is replaced in the aligned apertures in the movable positioning bar 115 and pivot block 117 for cooperation with the fixed positioning bar 113 to prevent the pallet 40 from rolling back off the track assemblies 100. It will be noted that the pallet 40 has a length somewhat less than the lengths of the track assemblies 100, whereby the head 121 of the plunger 120 engages the adjacent end of the pallet 40 and resiliently urges it into engagement with the upstanding flange 113*a* of the fixed positioning bar 113. The adjustability of the plunger 120 permits the accommodation on the track assemblies 100 of slightly different sized pallets 40, which pallets are normally not constructed to precise dimensions. Furthermore, it will be noted that the portions of the inner rails 108 and outer top rails 104 of the track assemblies 100 which extend upwardly above the support plane of the rollers 110 cooperate for engagement with the adjacent side surfaces of the pallet feet 41 and 42 to prevent lateral movement of the pallet 40 off the track assemblies 100. Thus, it can be seen that the pallet 40 is limited in both longitudinal and lateral horizontal movement and is held in a position centered on the turntable 90 substantially coaxially therewith during rotation thereof.

In order further to secure the pallet 40 and coil 31 on the turntable 90 and prevent relative vertical movement thereof, there is provided a hold-down assembly, generally designated by the numeral 130, which includes an elongated vertically-extending shaft 131 provided at the upper end thereof with a handle 132 and having a roll pin 133 extending diametrically therethrough adjacent to the lower end thereof and extending radially outwardly therefrom a predetermined distance on either side thereof. Surrounding the shaft 131 adjacent to the upper end thereof is a helical compression spring 134, beneath which is disposed a holddown bracket, generally designated by the numeral 135, which includes a cylindrical hub 136 freely slidable axially of the shaft 131 and a plurality of equiangularly spaced-apart arms 137 fixedly secured to the hub 136 and extending radially outwardly therefrom a distance at least as great as the maximum outer radius of the coil 31. In use, when the pallet 40 with the coil 31 thereon is secured in position on the track assemblies 100, the shaft 131 is extended downwardly through the coil 31 axially thereof and into the hub 93 of the turntable 90, and the roll pin 133 is twisted into locking engagement in the right-angle slots 94 in the hub 93. The arms 137 of the holddown bracket 135 rest upon the upper side surface 34 of the coil 31 and are resiliently urged thereagainst by the compression spring 134.

When the pallet 40 and coil 31 have thus been secured in place on the track assemblies 100, the coil 31 is ready for dispensing of the steel strapping material therefrom by rotation of the turntable 90 through the action of the air motor 75, the sprockets 76 and 80 and the drive chain 77, the turntable 90 being adapted for clockwise rotation, as viewed in the drawings, for unreeling a withdrawn portion 35 of the steel strapping material from the coil 31. Preferably, the withdrawn portion 35 of the steel strapping material is fed to the associated strapping machine 36 through the accumulator tower 150, which is of essentially standard construction and function to take up the slack in the withdrawn portion 35 of the steel strapping material, and provide a constant drag on the strapping material between the strapping machine 36 and the accumulator tower 150.

Figure 1:
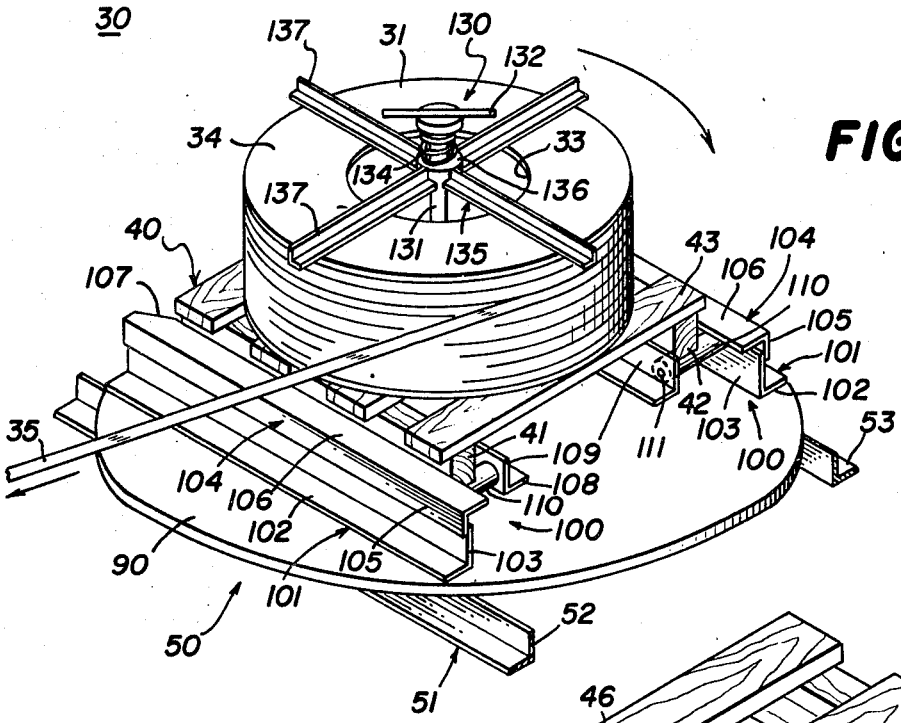
FIG. 1 is a fragmentary front perspective view of a portion of the dispensing system constructed in accordance with and embodying the features of the present invention.
Figure 2:
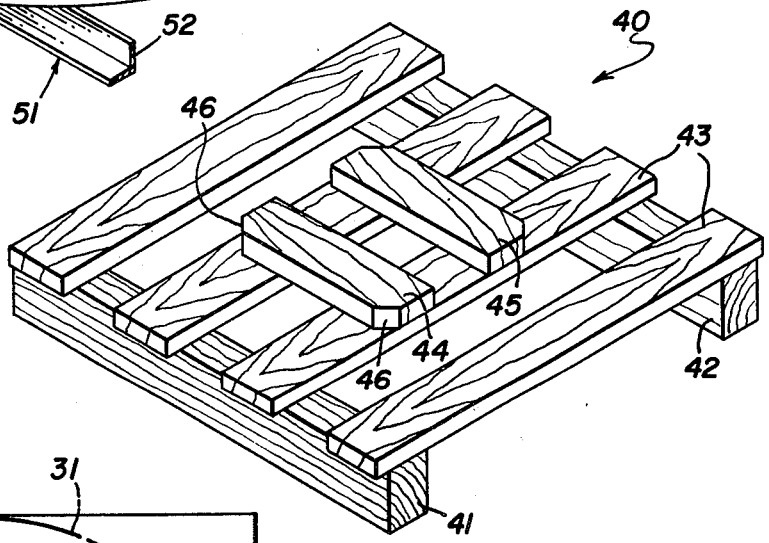
FIG. 2 is a front perspective view of the coil pallet of the present invention.
Figure 3:
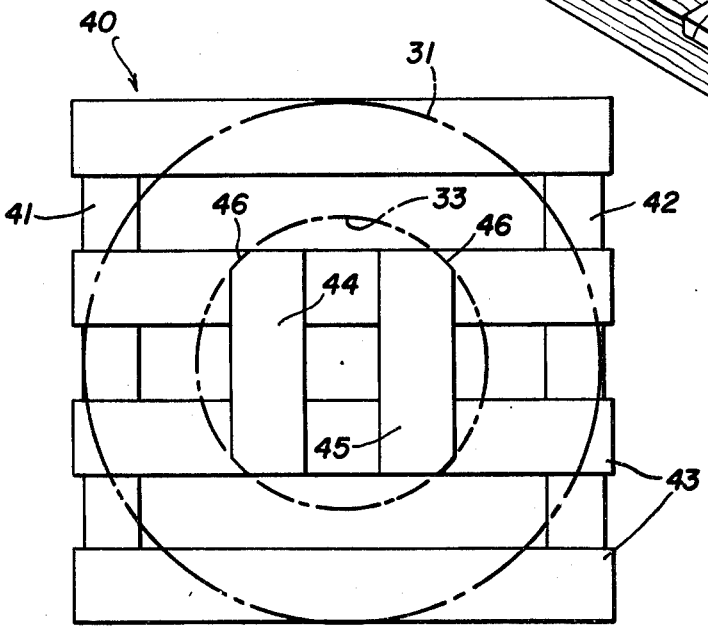
FIG. 3 is a top plan view of the coil pallet of FIG. 2, with the position of the coil thereon illustrated in phantom.
Figures 4, 10:
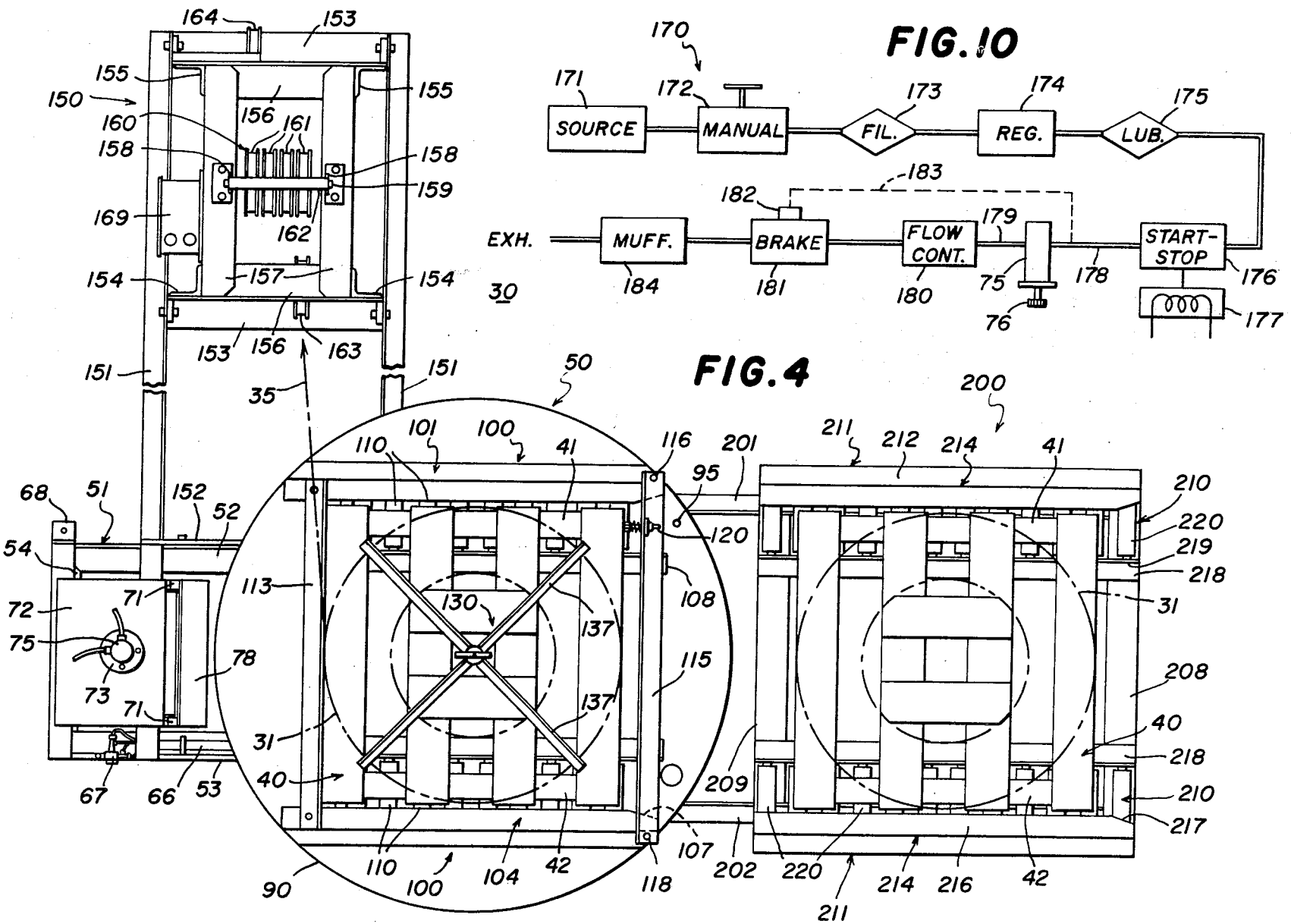
FIG. 4 is a top plan view of the dispensing system of the present invention, including the entry conveyor and illustrating as associated accumulator tower, with the positions of the strap coil in the system illustrated in phantom.
FIG. 10 is a schematic diagram of the pneumatic control circuit of the present invention.
Figure 9:
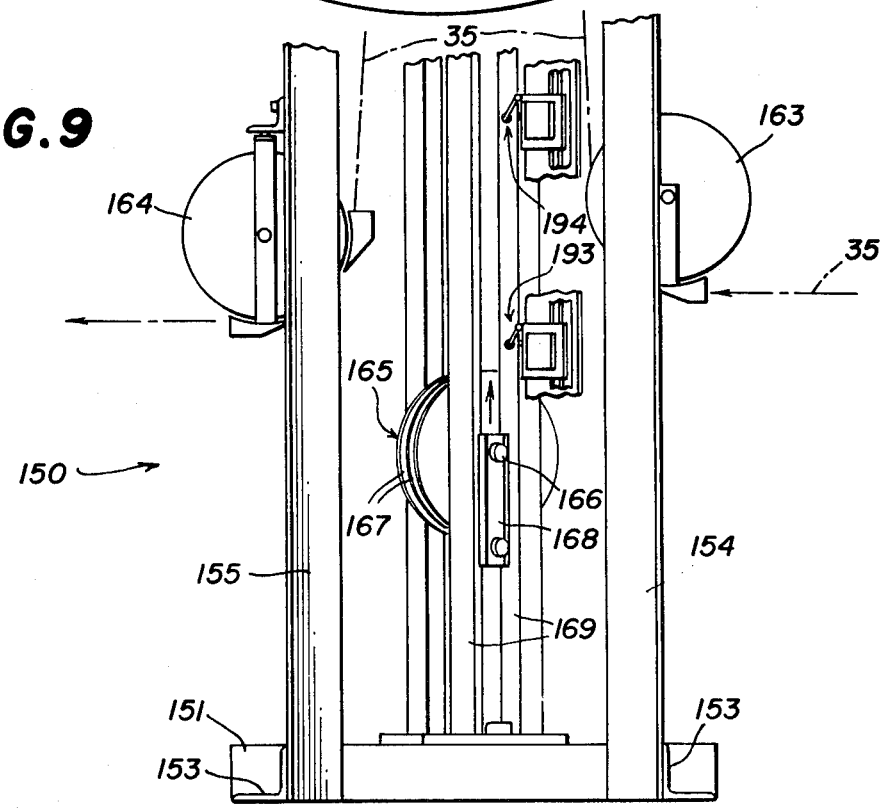
FIG. 9 is a fragmentary side elevational view of the accumulator tower shown in FIG. 4, as viewed from the lefthand side thereof, with a portion thereof broken away more clearly to illustrate the control switches.

Referring in particular to FIGS. 4 and 9 of the drawings, the accumulator tower 150 includes a pair of elongated, spaced-apart, parallel base rails 151 which are interconnected at one end thereof by a connecting plate 152 which is in turn fixedly secured to the side rail 52 of the turntable assembly 50 by suitable fastening means. The base rails 151 are also interconnected at the other end thereof and intermediate the ends thereof, respectively, by a pair of cross rails 153. Respectively fixedly secured to the opposite ends of the intermediate cross rail 153 along the inner side thereof are two elongated upstanding support posts 154, and respectively fixedly secured to the opposite ends of the end cross rail 153 along the inner side thereof are two elongated upstanding support posts 155. A pair of brace bars 156 respectively interconnect the posts 154 and the posts 155 intermediate the upper and lower ends thereof. Respectively connecting the upper ends of the support posts 154 to the upper ends of the corresponding support posts 155 are two top rails 157 which are disposed substantially parallel to the base rails 151 inboard thereof. Respectively extending vertically upwardly from the top rails 157 substantially midway between the ends thereof are two top posts 158.

Disposed between the top posts 158 is a fixed upper sheave assembly, generally designated by the numeral 160, which includes four sheaves 161 coaxially mounted for rotation on a shaft 159, the opposite ends of which are respectively received in complementary openings in the top posts 158. Also mounted on the top posts 158 and extending across the top of the fixed upper sheave assembly 160 is a guide bar 162 having guide fingers (not shown) which respectively extend into the sheaves 161 for cooperation therewith to facilitate maintenance of the strip of strapping material in place on the sheaves 161. Carried by one of the support posts 154 just below the associated brace bar 156 is an entry sheave 163 mounted for rotation about a substantially horizontal axis. In like manner, there may be mounted on one of the support posts 155, just below the corresponding brace bar 156, an exit sheave 164, which is also mounted for rotation about a substantially horizontal axis. Disposed beneath the fixed upper sheave assembly 160 is a movable lower sheave assembly, generally designated by the numeral 165, which includes three sheaves 167 coaxially mounted for rotation about a shaft 166, the axis of which is disposed at an acute angle to the axis of the shaft 159 of the fixed upper sheave assembly 160. The opposite ends of the shaft 166 are respectively secured to vertically-extending guide shoes 168 which are in turn respectively disposed for vertical sliding movement in upstanding guide track assemblies 169.

In operation, the withdrawn portion 35 of the steel strapping material is fed from the coil 31 into and beneath the entry sheave 163, then upwardly in front of, over and around the right-hand one of the upper sheaves 161, as viewed in FIG. 4, then downwardly behind and beneath the corresponding one of the lower sheaves 167, then back up in front of and over the next sheave 161, and so on, and finally beneath the exit sheave 164, it being understood that the use of the exit sheave 164 is optional. Thus, a length of steel strapping material is stored between the fixed and movable sheave assemblies 160 and 165, it being understood that the maximum length of strapping material which may be so stored is variable with the height of the accumulator tower 150 and the number of sheaves in the sheave assemblies 160 and 165. As the strapping machine 36 demands strapping material from the accumulator tower 150, the movable sheave assembly 165 is pulled upwardly and the amount of strapping material stored in the accumulator tower 150 is reduced. In like manner, as strapping material is fed to the accumulator tower 150 from the turntable assembly 50 by rotation thereof, the weight of the movable sheave assembly 165 permits it to drop to take the slack of the newly dispensed strapping material, thereby increasing the amount of strapping material stored in the accumulator tower 150.

Thus, the withdrawn portion 35 of the strapping material from the coil 31 is always kept under a slight tension and the buildup of slack is prevented. This is important because if the withdrawn portion 35 of the strapping material goes slack, the loops on the coil 31 will be permitted to slip down over each other, thus producing a jam condition. Furthermore, the strapping material is often quite resilient and is usually wound in coils having a radius of curvature substantially less than that of the so-called "coil-set" or "bundle curve" (residual curvature), if any, of the strapping. As a result, untensioned or slack lengths of such metal strapping outside the confines of the coil tend quickly to get out of control, and buckling and tangles often result.

Referring now also to FIGS. 10 and 11 of the drawings, in order to coordinate the operation of the turntable assembly 50 with the demands of the strapping machine 36, there is provided a control system which includes a pneumatic control circuit, generally designated by the numeral 170, and an electrical control circuit, generally designated by the numeral 190. The pneumatic control circuit 170 includes a suitable source 171 of compressed air which is coupled through a manually-operated input valve 172, a filter 173, a regulator 174 and a lubricator 175 to the input port of a control valve 176, the opening and closing of which is controlled by a solenoid 177. The input valve 172 is in the nature of a master valve which is normally open but which may be manually closed in the event of emergency, or the like, to shut down the entire system. The output port of the control valve 176 is coupled by an input conduit 178 to the input port of the air motor 75, the output port of which is coupled by an output conduit 179 to a flow control unit 180, which is in turn coupled to the input port of a brake valve 181, which is provided with a pilot 182 coupled by a pilot conduit 183 to the input conduit 178 of the air motor 75. The output port of the brake valve 181 is coupled to a muffler 184, through which the air is exhausted. The lubricator 175 is for the purpose of lubricating the air motor 75.

It will be understood that when the control valve 176 is open, compressed air is supplied to the air motor 75 for effecting rotation thereof and driving the turntable 90, the air being supplied to the pilot 182 of the brake valve 181 for maintaining that valve open. When the control valve 176 is closed, the air motor 75 is de-energized. The cutoff of the air supply to the pilot 182 effects closing of the brake valve 181, thereby shutting off the exhaust from the air motor 75, thus serving to retard rotation of the air motor shaft to produce a braking effect on the turntable 90 and limit its tendency to coast by reason of the considerable inertia developed by the heavy coil 31.

The solenoid 177 of the control valve 176 is controlled by the electrical control circuit 190, which is connected across the conductors $L_1$ and $L_2$ of a standard 115-volt, single-phase, 60 Hz. electrical power source. More particularly, the conductor $L_1$ is connected through a fuse 191 and a normally-open manually-operated master switch 192 to one terminal of a normally-closed "stop" limit switch 193, the other terminal of which is connected to one terminal of a normally-open "start" limit switch 194. The other terminal of the "start" limit switch 194 is connected to one terminal of the relay coil 195*a* of a relay 195, the other terminal of which coil is connected to the conductor $L_2$. The relay 195 has normally-open contacts 195*b* which are connected in parallel with the "start" limit switch 194. Connected in parallel with the relay coil 195*a* is the series combination of normally-closed time-delay relay contacts 195*c* and the solenoid 177 of the control valve 176. Also connected in parallel with the relay coil 195*a* is the series combination of normally-open time-delay relay contacts 195*d* and an indicator lamp 196. The limit switch contacts 193 and 194 are physically located on one of the guide track assemblies 169 of the accumulator tower 150, for actuation by the corresponding one of the guide shoes 168. More particularly, referring to FIG. 9, the "stop" limit switch 193 is disposed adjacent to the lower end of the guide track assembly 169, and the "start" limit switch 194 is located a predetermined distance above the "stop" limit switch 193.

In operation, when the master switch 192 is closed, and if the guide shoe 168 is disposed below the "start" limit switch 194, the relay coil 195*a* and solenoid 177 and lamp 196 will all remain de-energized by reason of the normally-open "start" limit switch 194 and relay contacts 195*b*. As strapping material is used from the accumulator tower 150 in response to the demand of the associated strapping machine 36, the movable sheave assembly 165 will move upwardly until, when the supply of strapping material in the accumulator tower 150 has been reduced to a predetermined quantity, the guide shoe 168 will engage and close the "start" limit switch 194, thereby energizing the relay coil 195*a* and the control valve solenoid 177 for starting the air motor 75 to rotate the turntable 90 and dispense strapping material to the accumulator tower 150.

Upon energization of the relay coil 195*a*, the contacts 195*b* thereof are closed to provide a holding circuit around the "start" limit switch 194 for maintaining the relay coil 195*a* energized, but the time-delay relay contacts 195*c* and 195*d* will remain in their normally closed and open conditions, respectively, until and unless the timer therefor times out, normally after several seconds. Preferably, the system is set up so that when both the strapping machine 36 and the turntable 90 are operating, the quantity of strapping material stored in the accumulator tower 150 will be maintained more or less in equilibrium. When the strapping machine 36 stops or slows down, however, the quantity of strapping material in the accumulator tower 150 will be built up and the movable sheave assembly 165 will move downwardly out of contact with the "start" limit switch 194, which will reopen. But the control valve solenoid 177 and relay coil 195*a* will remain energized through the closed relay contacts 195*b*.

When the guide shoe 168 drops to the point where a predetermined desired maximum amount of strapping material is stored in the accumulator tower 150, it will engage and open the "stop" limit switch 193, thereby de-energizing the relay coil 195*a* and the control valve solenoid 177, whereupon the air motor 75 is deactuated and the relay contacts 195*b* are reopened. The "stop" limit switch 193 is set high enough so that when the turntable 90 is shut off, the coast of the turntable 90 is not sufficient to allow the movable sheave assembly 165 to bottom out.

The time delay on the relay contacts 195*c* and 195*d* is set long enough so that in normal operation it will not time out. However, in the event of malfunction, such as jamming of the movable sheave assembly 165, or malfunction of the "stop" limit switch 193, the delay timer will time out and the relay contacts 195*c* will open to de-energize the control valve solenoid 177 and shut down the turntable 90, and the relay contacts 195*d* will close to energize the lamp 196 and give an indication that the timer has timed out. In this event, the system may be reset by opening the master switch 192, which will de-energize the relay coil 195*a* and drop the relay contacts 195*c* and 195*d* back to their original positions. It will be appreciated that the positions of the limit switches 193 and 194 may be varied as desired to meet the varying demands of specific applications.

In order to facilitate loading of the pallet 40 onto the turntable track assemblies 100, there may be provided an entry conveyor assembly, generally designated by the numeral 200, for use with the turntable assembly 50. Referring to FIGS. 4, 5 and 7 of the drawings, the entry conveyor assembly 200 includes a pair of elongated laterally spaced-apart parallel base rails 201 and 202 each provided at one thereof with an abutment plate 203. The base rails are interconnected adjacent to the abutment plates 203 by a crossbar (not shown). Respectively extending upwardly from the base rails 201 and 202 a slight distance forwardly of the crossbar 204 are two stub posts 205, one of which is provided at the upper end thereof with a flat rectangular pin plate 206 having an aperture therein dimensioned for receiving either of the release pivot pins 116 or 118 of the turntable track assemblies 100. Fixedly secured to the base rails 201 and 202 and extending vertically upwardly therefrom are four support posts 207, two of the posts 207 being disposed adjacent to the front ends of the base rails 201 and 202 and being interconnected at the upper ends thereof by a horizontal front support bar 208, the other two of the support posts 207 being disposed intermediate the ends of the base rails 201 and 202 and being interconnected at the upper ends thereof by a horizontal rear support bar 209.

Supported upon the support bars 208 and 209 are two elongated track assemblies, each being generally designated by the numeral 210, and respectively overlying the base rails 201 and 202 substantially parallel thereto. The track assemblies 210 are substantially identical to the track assemblies 100 of the turntable assembly 50. More particularly, each track assembly 210 includes a bottom outer rail 211 in the form of an angle iron having an attachment flange 212 fixedly secured to the upper surfaces of the support bars 208 and 209, and an upstanding inner bearing flange 213. An outer top rail 214, also in the form of an angle iron, has a vertically disposed attachment flange 215 arranged in parallel overlapping relationship with the bearing flange 213 of the outer bottom rail 211 and fixedly secured thereto as by welding, and also having a horizontally disposed and inwardly extending retaining flange 216, provided at the front end thereof with a tapered entry portion 217. Spaced radially inwardly from the outer bottom rail 211 and disposed parallel thereto is an elongated inner rail 218 which is fixedly secured to the support bars 208 and 209 and is provided with an upstanding bearing flange 219.

Disposed between the outer bottom rail 211 and the inner rail 218 is a plurality of laterally extending and longitudinally spaced-apart cylindrical rollers 220, each being mounted for rotation about a substantially horizontal shaft 221, the opposite ends of which are respectively received in complementary openings in the bearing flanges 213 and 219 of the rails 211 and 218. The rollers 220 are so arranged that the upper surfaces thereof are all disposed tangent to a common support plane which, in use, is substantially coplanar with the support plane defined by the rollers 110 of the track assemblies 100, and is disposed a predetermined distance below the upper edges of the bearing flange 213 and the retaining flange 216. The width of each of the track assemblies 210, and the spacing therebetween is such that the elongated feet 41 and 42 of a pallet 40 may be respectively received in rolling engagement with the rollers 220 of the two track assemblies 210 for free rolling transport therealong.

Respectively extending between the retaining flanges 216 of the track assemblies 210 adjacent to the opposite ends thereof are two removable stop bars (not shown) having the opposite ends thereof respectively securable to the retaining flanges 216 by suitable pins (not shown) engageable in complementary aligned openings in the stop bars and the retaining flanges 216. Preferably, the stop bars are disposed substantially parallel to each other and are spaced apart a distance slightly greater than the normal length of a pallet 40.

In operation, the entry conveyor assembly 200 is disposed adjacent to the front end of the turntable assembly 50, with the base rails 201 and 202 disposed parallel to the turntable frame side rails 52 and 53, and with the abutment plates 203 disposed in abutting parallel relationship with the end rail 55 of the turntable assembly 50, and fixedly secured thereto by suitable fastening means passing through complementary openings in the abutment plates 203 and the end rail 55. When thus secured in this position (see FIG. 4) the pin plate 206 will be disposed immediately beneath the peripheral edge of the turntable 90. The turntable 90 is rotated until the pin aperture 95 thereof is disposed in alignment with the corresponding pin aperture in the pin plate 206, and one of the release pivot pins 116 or 118 is removed from the movable positioning bar 115 and placed through the aligned pin apertures in the turntable 90 and pin plate 206 for locking the turntable 90 against rotation with respect to the entry conveyor assembly 200. When thus locked in position, the track assemblies 100 of the turntable assembly 50 will respectively be disposed in alignment with the track assemblies 210 of the entry conveyor assembly 200, and will respectively be spaced longitudinally therefrom a slight distance only a fraction of the length of a pallet 40.

Preferably, the entry conveyor assembly 200 is utilized for storing a spare pallet 40 and coil 31 for ready availability for immediate use when the coil 31 on the turntable 90 is exhausted. The pallet 40 may be loaded onto the track assemblies 210 of the entry conveyor assembly 200 in the same manner as was described above with respect to the turntable assembly 50, by the use of a forklift truck or the like. For this purpose the front stop bar is pivoted about one of the pins to a position substantially parallel with the track assemblies 210, and the pallet 40 is rolled onto the track assemblies 210 from the front end thereof, the tapered ends 217 of the retaining flanges 216 facilitating the guiding of the pallet feet 41 and 42 onto the track assembly rollers 220. The front stop bar is then secured in place back across the front end of the entry conveyor assembly 200 and cooperates with the rear stop bar to limit longitudinal movement of the pallet 40. The portions of the inner rails 218 and the outer top rails 214 of the track assemblies 210 which extend upwardly above the support plane of the rollers 220 cooperate for engagement with the adjacent side surfaces of the pallet feet 41 and 42 to prevent lateral movement of the pallet 40 off the track assemblies 210.

When the coil 31 on the turntable 90 has become exhausted, the hold-down assembly 130 is removed and the empty pallet 40 is lifted off the turntable 90. The movable positioning bar 115 is then moved from the holding condition thereof to the retracted condition thereof by removal of one of the release pivot pins 116 or 118, and the turntable 90 is rotated to the position illustrated in FIG. 4 with the track assemblies 100 thereof aligned with the track assemblies 210 of the entry conveyor 200, and is locked in this position by the use of one of the release pivot pins 116 or 118, as described above. The rear stop bar is then removed from the entry conveyor track assemblies 210 and the new pallet 40 may simply be rolled by hand from the entry conveyor track assemblies 210 onto the turntable track assemblies 100, after which the removable positioning bar 115 is again locked in the holding condition thereof and the hold-down assembly 130 is reapplied to the new coil 31. In this manner, the pallet on the turntable assembly 50 may be replaced by hand literally in a matter of seconds or, at most minutes, without having to wait for a new pallet and coil to be brought from the storage area by forklift truck. Thus, the downtime of the strapping machine 36 is minimized.

Referring now also to FIGS. 12 and 13 of the drawings, there are illustrated several configurations in which the dispensing system 30 may be arranged. As illustrated in FIG. 12, the entry conveyor assembly 200 may be arranged as illustrated in FIG. 4, with the base rails 201 and 202 respectively disposed parallel to the turntable assembly frame side rails 52 and 53, for loading the turntable 90 from the side thereof away from the air motor 75. Alternatively, the entry conveyor assembly may be positioned at the rear of the turntable assembly 50, as indicated by the designation 200A. In this latter arrangement, the side rail 53 of the turntable assembly 50 is provided with suitable openings for receiving therethrough the fastening members for securing the abutment plates 203 to the side rail 53.

In FIG. 13 is illustrated an alternative arrangement wherein the air motor end of the turntable assembly 50 is disposed at the side thereof away from the accumulator tower 150. In this arrangement the accumulator tower 150 may be independently secured to the floor or underlying support surface by means of suitable hold-down brackets **151*a* rather than by the base rails 151. In this arrangement of the turntable assembly 50 the entry conveyor assembly may be positioned at the side thereof away from the air motor 75, as has been described above. Alternatively, the entry conveyor may be positioned at the rear of the turntable assembly 50, on the opposite side thereof from the accumulator tower 150, as indicated by the numeral 200A. In this latter arrangement, the turntable assembly frame side rail 52 is provided with suitable apertures for receiving the fastening means for securing thereto the abutment plates 203 of the entry conveyor assembly 200**.

Preferably, the structural members of the strap dispensing system 30 are all formed of steel, and the structural members **52–56, 68, 78, 101, 104, 108, 103, 105, 137, 151, 151*a*, 153–157, 201, 202, 211, 214 and 218 are all preferably formed as angle irons. Preferably, the structural members of each of the turntable assembly 50, the accumulator tower 150 and the entry conveyor assembly 200** are secured together by welding, but it will be understood that any other suitable fastening means may be utilized.

From the foregoing, it can be seen that there has been provided an improved strap dispensing system for dispensing strapping material from very heavy coils thereof by unreeling the coils on their sides with the rotational axes thereof disposed vertically, so that the coils do not have to be tipped up on end.

There has also been provided a strap dispensing system of the character described, in which the strap coils are permanently mounted on special pallets, the entire pallet being mounted on the dispensing apparatus, thereby eliminating handling of the coil itself.

There has also been provided a unique strap dispensing system of the character described, wherein the pallet is disposed and accurately held in position on a turntable for unreeling of the coil.

More particularly, there has been provided a strap dispensing system of the character described, wherein the turntable is provided with roller-type track assemblies for facilitating movement of the pallet onto the turntable.

There has also been provided an improved strap dispensing system which includes control means for controlling the rotation of the turntable and consequent unreeling of the strapping material from the coil in accordance with the demands of associated strap utilization equipment.

In addition, there has been provided a strap dispensing system of the character described, which includes entry conveyor means for facilitating movement of a pallet onto the turntable to minimize changeover time.

Finally, there has been provided a strap dispensing system which affords a plurality of configurations of turntable assembly and entry conveyor assembly for adaptation of the system to varying space requirements.

While there have been described what are at present considered to be the preferred embodiments of the invention, it will be understood that various modifications may be made therein, and it is intended to cover in the appended claims all such modifications as fall within the true spirit and scope of the invention.

What is claimed is:

1. Apparatus for dispensing a continuous strip of strapping material from a heavy coil thereof supported on and held against horizontal movement with respect to a pallet having a pair of spaced-apart feet depending therefrom with the axis of the coil disposed substantially vertically, said apparatus comprising a substantially horizontal turntable mounted for rotation about a substantially vertical axis and having a pair of elongated laterally spaced-apart track assemblies thereon, said turntable being adapted for receiving the pallet thereon in a dispensing position with the pallet feet respectively received in said track assemblies and with the coil disposed substantially coaxially with said turntable, said track assemblies being respectively engageable with the pallet feet for preventing horizontal movement of the pallet from the dispensing position thereof laterally of said track assemblies, two pallet positioning members respectively carried by said turntable adjacent to the opposite ends of said track assemblies and engageable with the pallet for preventing the horizontal movement thereof from the dispensing position thereof longitudinally of said track assemblies, and drive means for effecting rotation of said turntable in a coil-unreeling direction, whereby strapping material may be dispensed directly from the pallet by rotation of said turntable without handling of the coil or removal thereof from the pallet.

2. The apparatus set forth in claim 1, wherein each of said track assemblies includes a pair of parallel laterally spaced-apart bearing rails fixedly secured to said turntable and projecting upwardly therefrom, and a plurality of longitudinally spaced-apart rollers extending laterally between said bearing rails and rotatably supported thereby and all tangent to a common substantially horizontal support plane disposed a predetermined distance below the upper edges of said bearing rails, the pallet feet being engageable with the portions of said bearing rails extending above said support plane for limiting horizontal movement of the pallet laterally of said track assemblies.

3. The apparatus set forth in claim 1, wherein each of said pallet positioning members extends laterally across both of said track assemblies and is secured thereto.

4. The apparatus set forth in claim 1, wherein one of said pallet positioning members is movable between a retracted condition accommodating horizontal movement of the pallet to and from the dispensing position thereof along said track assemblies and a holding condition for preventing horizontal movement of the pallet from the dispensing position thereof longitudinally of said track assemblies.

5. Apparatus for dispensing a continuous strip of strapping material from a heavy coil thereof to associated strap-utilizing equipment wherein the coil is supported on a pallet and held against horizontal movement with respect thereto with the axis of the coil disposed substantially vertically, said apparatus comprising a substantially horizontal turntable mounted for rotation about a substantially vertical axis and adapted for receiving the pallet thereon in a dispensing position with the coil disposed substantially coaxially with said turntable, pallet positioning means on said turntable for holding the pallet in the dispensing position thereof, drive means for effecting rotation of said turntable in a coil-unreeling direction, accumulating means disposed between said turntable and the associated strap-utilizing equipment for storing unreeled strapping material dispensed from the coil and feeding it to the associated strap-utilizing equipment, said accumulating means including a storage member engageable with the stored strap and movable among a plurality of positions for varying the capacity of the accumulating means, and control means coupled to said drive means and responsive to the position of said storage member for sensing the quantity of strapping material accumulated in said accumulating means, said control means deactuating said drive means when the amount of accumulated strapping material is at least a predetermined quantity and for actuating said drive means when the amount of accumulated strapping material is less than said predetermined quantity, whereby strapping material may be dispensed directly from the pallet by rotation of said turntable without handling of the coil or removal thereof from the pallet.

6. Apparatus for dispensing a continuous strip of strapping material from a heavy coil thereof supported on a pallet and held against horizontal movement with respect thereto with the axis of the coil disposed substantially vertically, said apparatus comprising a substantially horizontal turntable mounted for rotation about a substantially vertical axis and having elongated low-friction track means thereon, said track means being adapted for receiving the pallet thereon and facilitating horizontal movement of the pallet therealong to a dispensing position with the coil disposed substantially coaxially with said turntable, elongated entry conveyor means disposed adjacent to said turntable for receiving a pallet thereon, coupling means for interconnecting and locking said turntable and said entry conveyor means in a loading configuration with said track means and said entry conveyor disposed in longitudinal alignment for facilitating horizontal movement of the pallet from said entry conveyor means onto said track means, pallet positioning means on said turntable for holding the pallet in the dispensing position thereof, and drive means for effecting rotation of said turntable in a strap-unreeling direction, whereby strapping material may be dispensed directly from the pallet by rotation of said turntable without handling of the coil or removal thereof from the pallet.

7. The apparatus set forth in claim 6, wherein said coupling means includes a coupling plate on said entry conveyor means disposable in parallel overlapping relationship with said turntable, and a coupling pin receivable through complementary openings in said turntable and said coupling plate.

8. The apparatus set forth in claim 6, wherein said pallet positioning means includes an elongated bar extending laterally across said track means and pivotally mounted adjacent to one end thereof for movement between a retracted condition for permitting movement of the pallet to and from the disposing position thereof and a holding condition for holding the pallet in the dispensing position thereof, a latch pin removably receivable through complementary openings in said bar and said track means for latching said bar in the holding condition thereof, said coupling means including a coupling plate on said entry conveyor means disposable in parallel overlapping relationship with said turntable, said coupling plate and said turntable having openings therein disposed in alignment when said turntable and said entry conveyor are in the loading configuration thereof for receiving said latch pin therethrough to latch said turntable and said entry conveyor in the loading configuration.

9. The apparatus set forth in claim 6, wherein said coupling means includes a first abutment plate on said turntable, a second abutment plate on said entry conveyor means respectively disposed for abutting engagement with said first abutment plate when said turntable and said entry conveyor means are in the loading configuration thereof, a coupling plate on said entry conveyor means disposed in parallel overlapping relationship with said turntable in the loading configuration thereof, and a latch pin receivable through complementary openings in said coupling plate and said turntable for cooperation with said abutment plates for holding said turntable and said entry conveyor means in the loading configuration thereof.

10. Apparatus for dispensing a continuous strip of strapping material from a heavy coil thereof supported on and held against horizontal movement with respect to a pallet having a pair of spaced-apart feet depending therefrom with the axis of the coil disposed substantially vertically, said apparatus comprising a substantially horizontal turntable mounted for rotation about a substantially vertical axis and having a pair of elongated laterally spaced-apart low-friction turntable track assemblies thereon, said turntable track assemblies being adapted for receiving the pallet thereon with the pallet feet respectively received therein and facilitating horizontal movement of the pallet therealong to a dispensing position with the coil disposed substantially coaxially with said turntable, said turntable track assemblies being respectively engageable with the pallet feet for preventing horizontal movement of the pallet from the dispensing position thereof laterally of said turntable track assemblies, an entry conveyor disposed adjacent to said turntable and having a pair of elongated laterally spaced-apart low-friction conveyor track assemblies for receiving a pallet thereon with the pallet feet respectively received therein, coupling means for interconnecting and locking said turntable and said entry conveyor in a loading configuration with said turntable track assemblies respectively disposed in longitudinal alignment with said conveyor track assemblies for facilitating horizontal movement of the pallet from said conveyor track assemblies onto said turntable track assemblies, two pallet positioning members respectively carried by said turntable adjacent to the opposite ends of said turntable track assemblies and engageable with the pallet for preventing horizontal movement thereof from the dispensing position thereof longitudinally of said turntable track assemblies, and drive means for effecting rotation of said turntable in a coil-unreeling direction, whereby strap may be dispensed directly from the pallet by rotation of said turntable without handling of the coil or removal thereof from the pallet.

11. The apparatus set forth in claim 10, wherein each of said turntable track assemblies and conveyor track assemblies includes a pair of parallel laterally spaced-apart bearing rails, a plurality of longitudinally spaced-apart rollers extending laterally between said bearing rails of each pair of rails and rotatably supported thereby and all tangent to a common substantially horizontal support plane disposed a predetermined distance below the upper edges of said bearing rails, the pallet feet being engageable with the portions of said bearing rails extending above said support plane for limiting horizontal movement of the pallet laterally of said track assemblies.

12. A strapping material assembly comprising a pallet having a substantially flat horizontal support surface, positioning means carried by said pallet and projecting upwardly from said support surface, and an elongated continuous strip of strapping material arranged in a coil on said pallet support surface with the axis of said coil disposed substantially vertically, said coil being disposed in engagement with said positioning means for preventing horizontal movement of said coil with respect to said pallet, whereby said coil may be unwound to dispense strapping material therefrom by rotation of said pallet about the axis of said coil without removal of said coil from said pallet.

13. The assembly set forth in claim 12, wherein said positioning means comprises hub structure disposed for snug engagement with the inner surface of said coil.

14. A system for dispensing a continuous strip of strapping material from a heavy coil thereof, said system comprising a coil of strapping material, a pallet supporting said coil thereon with the axis of said coil disposed substantially vertically, coil positioning means carried by said pallet for engagement with said coil to prevent horizontal movement thereof with respect to said pallet, a substantially horizontal turntable mounted for rotation about a substantially vertical axis and adapted for receiving said pallet thereon in a dispensing position with said coil disposed substantially coaxially with said turntable, pallet positioning means on said turntable for holding said pallet in the dispensing position thereof, and drive means for effecting rotation of said turntable in a coil-unreeling direction, whereby strapping material may be dispensed directly from said pallet by rotation of said turntable without handling of said coil or removal thereof from said pallet.

15. The system set forth in claim 14, wherein said coil positioning means comprises a hub structure snugly engaging the inside of said coil.

16. A system for dispensing a continuous strip of strapping material from a heavy coil thereof, said system comprising a coil of strapping material, a pallet supporting said coil thereon with the axis of said coil disposed substantially vertically, coil positioning means carried by said pallet for engagement with said coil to prevent horizontal movement thereof with respect to said pallet, said pallet having a pair of elongated substantially parallel laterally spaced-apart feet depending therefrom, a substantially horizontal turntable mounted for rotation about a substantially vertical axis and having a pair of elongated laterally spaced-apart track assemblies thereon, said turntable being adapted for receiving said pallet thereon in a dispensing position with said feet respectively received in said track assemblies and with said coil disposed substantially coaxially with said turntable, said track assemblies being respectively engageable with said feet for preventing horizontal movement of said pallet from the dispensing position thereof laterally of said track assemblies, two pallet positioning members respectively carried by said turntable adjacent to the opposite ends of said track assemblies and engageable with said pallet for preventing horizontal movement thereof from the dispensing position thereof longitudinally of said track assemblies, and drive means for effecting rotation of said turntable in a coil-unreeling direction, whereby strapping material may be dispensed directly from said pallet by rotation of said turntable without handling of said coil or removal thereof from said pallet.

17. The system set forth in claim 16, wherein each of said track assemblies includes a pair of parallel laterally spaced-apart bearing rails fixedly secured to said turntable and projecting upwardly therefrom, and a plurality of longitudinally spaced-apart rollers extending laterally between said bearing rails and rotatably supported thereby and all tangent to a common substantially horizontal support plane disposed a predetermined distance below the upper edges of said bearing rails, said pallet feet being engageable with the portions of said bearing rails extending above said support plane for limiting horizontal movement of said pallet laterally of said track assemblies.

18. A system for dispensing a continuous strip of strapping material from a heavy coil thereof, said system comprising a coil of strapping material, a pallet supporting said coil thereon with the axis of said coil disposed substantially vertically, coil positioning means carried by said pallet for engagement with said coil to prevent horizontal movement thereof with respect to said pallet, a substantially horizontal turntable mounted for rotation about a substantially vertical axis and having low-friction track means thereon, said track means being adapted for receiving said pallet thereon and facilitating horizontal movement of said pallet therealong to a dispensing position with said coil disposed substantially coaxially with said turntable, entry conveyor means disposed adjacent to said turntable for receiving a pallet thereon and facilitating horizontal movement of said pallet onto said track means, pallet positioning means on said turntable for holding said pallet in the dispensing position thereof, and drive means for effecting rotation of said turntable in a coil-unreeling direction, whereby strapping material may be dispensed directly from said pallet by rotation of said turntable without handling of said coil or removal thereof from said pallet.

19. The system set forth in claim 18, and further including coupling means for interconnecting and locking said turntable and said entry conveyor means in a loading configuration with said track means and said entry conveyor disposed in longitudinal alignment for facilitating horizontal movement of said pallet from said entry conveyor means onto said track means.

20. A system for dispensing a continuous strip of strapping material from a heavy coil thereof, said system comprising a coil of strapping material, a pallet supporting said coil thereon with the axis of said coil disposed substantially vertically, coil positioning means carried by said pallet for engagement with said coil to prevent horizontal movement thereof with respect to said pallet, said pallet having a pair of elongated substantially parallel laterally spaced-apart feet depending therefrom, a substantially horizontal turntable mounted for rotation about a substantially vertical axis and having a pair of elongated laterally spaced-apart low-friction turntable track assemblies thereon, said turntable track assemblies being adapted for receiving said pallet thereon with said feet respectively received therein and facilitating horizontal movement of said pallet therealong to a dispensing position with said coil disposed substantially coaxially with said turntable, said turntable track assemblies being respectively engageable with said feet for preventing horizontal movement of said pallet from the dispensing position thereof laterally of said turntable track assemblies, an entry conveyor disposed adjacent to said turntable and having a pair of elongated laterally spaced-apart low-friction conveyor track assemblies for receiving a pallet thereon with said feet respectively received therein, coupling means for interconnecting and locking said turntable and said entry conveyor in a loading configuration with said turntable track assemblies respectively disposed in longitudinal alignment with said conveyor track assemblies for facilitating horizontal movement of said pallet from said conveyor track assemblies onto said turntable track assemblies, two pallet positioning members respectively carried by said turntable adjacent to the opposite ends of said turntable track assemblies and engageable with said pallet for preventing horizontal movement thereof from the dispensing position thereof longitudinally of said turntable track assemblies, and drive means for effecting rotation of said turntable in a coil-unreeling direction, whereby strap may be dispensed directly from said pallet by rotation of said turntable without handling of said coil or removal thereof from said pallet.

* * * * *